US010914120B2

(12) United States Patent
Menger et al.

(10) Patent No.: US 10,914,120 B2
(45) Date of Patent: Feb. 9, 2021

(54) FLEXIBLE COLLAR FOR A ROTARY STEERABLE SYSTEM

(71) Applicant: HALLIBURTON ENERGY SERVICES, INC., Houston, TX (US)

(72) Inventors: Christian Menger, Missouri, TX (US); Satish Rajagopalan, Tomball, TX (US); Daniel Winslow, Spring, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 16/341,873

(22) PCT Filed: Oct. 17, 2017

(86) PCT No.: PCT/US2017/057003
§ 371 (c)(1),
(2) Date: Apr. 12, 2019

(87) PCT Pub. No.: WO2018/085042
PCT Pub. Date: May 11, 2018

(65) Prior Publication Data

US 2019/0234148 A1 Aug. 1, 2019

Related U.S. Application Data

(60) Provisional application No. 62/418,044, filed on Nov. 4, 2016.

(51) Int. Cl.
*E21B 7/06* (2006.01)
*E21B 17/05* (2006.01)
(Continued)

(52) U.S. Cl.
CPC ..... *E21B 7/062* (2013.01); *E21B 7/06* (2013.01); *E21B 7/10* (2013.01); *E21B 17/05* (2013.01); *E21B 47/024* (2013.01)

(58) Field of Classification Search
CPC . E21B 7/04; E21B 7/062; E21B 7/068; E21B 47/024
See application file for complete search history.

(56) References Cited

U.S. PATENT DOCUMENTS

2004/0104051 A1 6/2004 Moriarty et al.
2011/0067925 A1 3/2011 Underwood et al.
(Continued)

FOREIGN PATENT DOCUMENTS

EA 018610 B1 9/2013
RU 2602851 C1 11/2016
WO WO-2015102584 A1 7/2015

OTHER PUBLICATIONS

Russia Patent Office, Application No. 2019109460, Translation of First Office Action and Search Report, dated Jul. 3, 2019, 2 pages, Russia.

(Continued)

*Primary Examiner* — Tara Schimpf

(57) ABSTRACT

A Rotary Steerable System (RSS) includes a flexible collar coupled therein that reduces the stiffness of the RSS and permits a tighter turning radius to be achieved. The positioning of the flexible collar between the steering section and the controller of the RSS further improves the turning radius, and may permit a push-the-bit system to operate similar to a point-the bit system. The flexible collar permits communication therethrough between controller and the steering sections of the RSS. The RSS may be arranged as a modular system to receive various configurations of a flexible collar and may operate with no flexible collar installed. The modularity enables tuning of the stiffness of an RSS to achieve different steering objectives.

20 Claims, 8 Drawing Sheets

(51) Int. Cl.
*E21B 7/10* (2006.01)
*E21B 47/024* (2006.01)

(56) References Cited

U.S. PATENT DOCUMENTS

| | | | | |
|---|---|---|---|---|
| 2012/0018225 | A1 | 1/2012 | Peter et al. | |
| 2013/0341091 | A1* | 12/2013 | Sugiura | E21B 7/04 175/24 |
| 2015/0107902 | A1 | 4/2015 | Downtown | |
| 2016/0060959 | A1* | 3/2016 | Lehr | E21B 7/062 175/61 |
| 2016/0084007 | A1* | 3/2016 | Sugiura | E21B 17/1092 175/61 |
| 2016/0108679 | A1 | 4/2016 | Bayliss | |
| 2017/0235012 | A1* | 8/2017 | Itskovich | E21B 7/04 175/24 |

OTHER PUBLICATIONS

Russia Patent Office, Application No. 2019109460, Search Report, dated Jun. 7, 2019, 2 pages, Russia.
Korean Intellectual Property Office, International Search Report and Written Opinion, PCT/US2017/057003, dated Jan. 26, 2018, 16 pages, Korea.
European Patent Office, Supplementary European Search Report, Application No. 17867876.9, dated Mar. 25, 2020, 9 pages.

* cited by examiner

FLEXIBLE COLLAR FOR A ROTARY STEERABLE SYSTEM

CROSS-REFERENCE TO RELATED APPLICATIONS (S)

This application is a U.S. national stage patent application of International Patent Application No. PCT/US2017/057003, filed on Oct. 17, 2017, which claims priority to U.S. Provisional Application No. 62/418,044 filed Nov. 4, 2016, entitled "Flex Collar for a Rotary Steerable System", the disclosures of which are hereby incorporated herein by reference in their entirety.

BACKGROUND

The present disclosure relates generally to rotary steerable systems (RSS), e.g., drilling systems employed for directionally drilling wellbores in oil and gas exploration and production. More particularly, embodiments of the disclosure relate to rotary steerable systems having flexible collar therein for achieving tighter steering radii.

Directional drilling operations involve controlling the direction of a wellbore as it is being drilled. Usually the goal of directional drilling is to reach a target subterranean destination with a drill string, and often the drill string will need to be turned through a tight radius to reach the target destination. Generally, an RSS changes direction either by pushing against one side of a wellbore wall with steering pads to thereby cause the drill bit to push on the opposite side (in a push-the-bit system), or by bending a main shaft running through a non-rotating housing to point the drill bit in a particular direction with respect to the rest of the tool (in a point-the-bit system). In a push-the-bit system, the wellbore wall is generally in contact with the drill bit, the steering pads and a stabilizer. The steering capability of such a system is predominantly defined by a curve that can be fitted through each of the drill bit, steering pads and the stabilizer.

BRIEF DESCRIPTION OF THE DRAWINGS

The disclosure is described in detail hereinafter, by way of example only, on the basis of examples represented in the accompanying figures, in which.

DETAILED DESCRIPTION

The present disclosure includes an RSS having a flexible collar coupled therein that reduces the stiffness of the RSS and permits a tighter turning radius to be achieved. The positioning of the flexible collar between the steering section and the controller of the RSS further improves the achievable turning radius. The flexible collar may be configured to permit communication therethrough between the controller and the steering section, and the RSS may be arranged as a modular system to receive various configurations of a flexible collar and may operate with no flexible collar installed.

Figure 1:
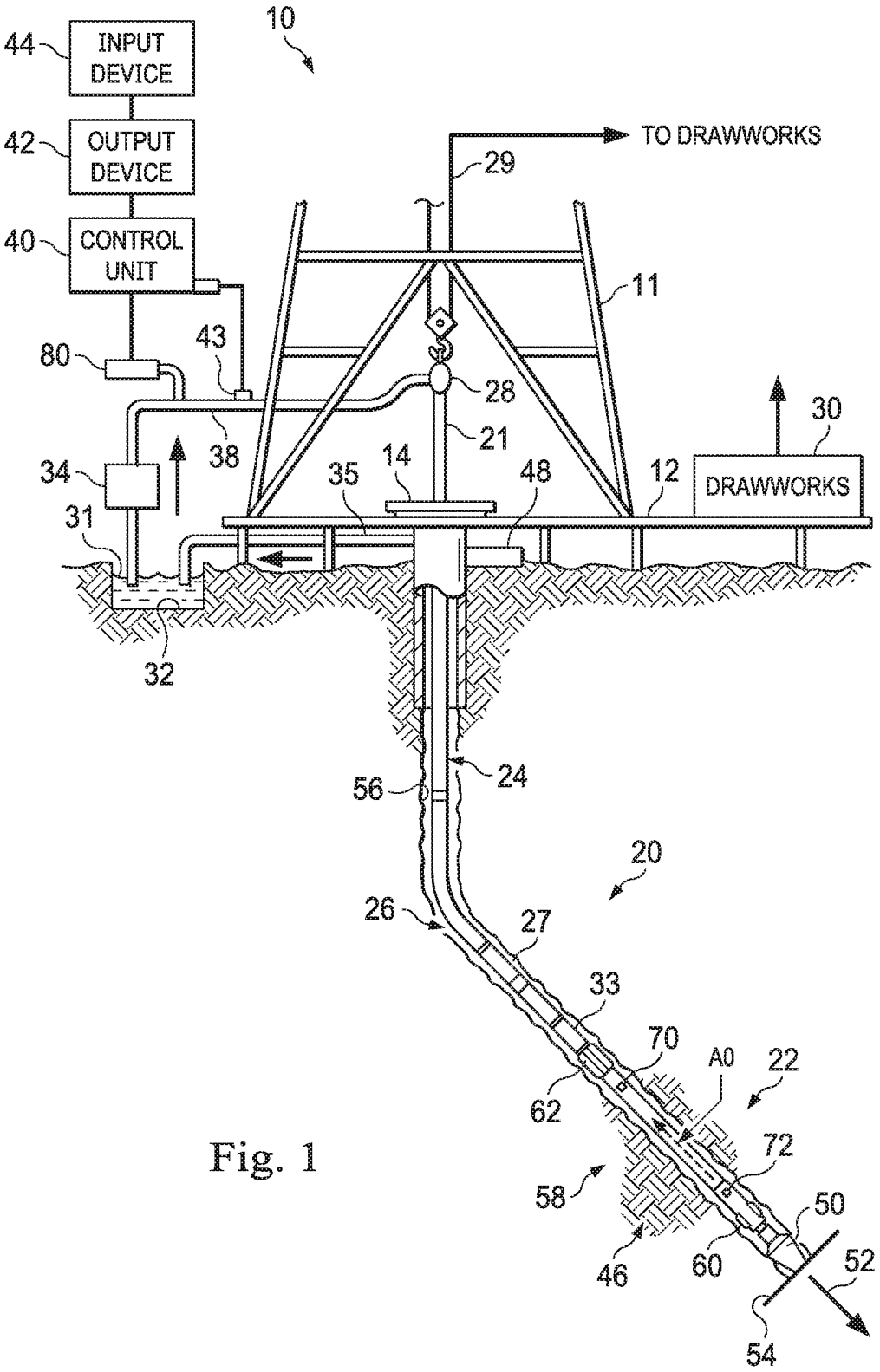
FIG. 1 is a partial cross-sectional side view of a directional wellbore drilled with a bottom hole assembly including an RSS.

FIG. 1 is a partial cross-sectional side view of a directional wellbore drilled with a bottom hole assembly (BHA) including an RSS. An exemplary directional drilling system 10 is illustrated including a tower or "derrick" 11 that is buttressed by a derrick floor 12. The derrick floor 12 supports a rotary table 14 that is driven at a desired rotational speed, for example, via a chain drive system through operation of a prime mover (not shown). The rotary table 14, in turn, provides the necessary rotational force to a drill string 20. The drill string 20, which includes a drill pipe section 24, extends downwardly from the rotary table 14 into a directional borehole 26. The borehole 26 may exhibit a multidimensional path or "trajectory." The three-dimensional direction of the bottom 54 of the borehole 26 of FIG. 1 is represented by arrow 52.

A drill bit 50 is attached to the distal, downhole end of the drill string 20. When rotated, e.g., via the rotary table 14, the drill bit 50 operates to break up and generally disintegrate the geological formation 46. The drill string 20 is coupled to a "drawworks" hoisting apparatus 30, for example, via a kelly joint 21, swivel 28, and line 29 through a pulley system (not shown). During a drilling operation, the drawworks 30 can be operated, in some embodiments, to control the weight on drill bit 50 and the rate of penetration of the drill string 20 into the borehole 26.

During drilling operations, a suitable drilling fluid or "mud" 31 can be circulated, under pressure, out from a mud pit 32 and into the borehole 26 through the drill string 20 by a hydraulic "mud pump" 34. Mud 31 passes from the mud pump 34 into the drill string 20 via a fluid conduit (commonly referred to as a "mud line") 38 and the kelly joint 21. Drilling fluid 31 is discharged at the borehole bottom 54 through an opening or nozzle in the drill bit 50, and circulates in an "uphole" direction towards the surface through an annular space 27 between the drill string 20 and the side 56 of the borehole 26. As the drilling fluid 31 approaches the rotary table 14, it is discharged via a return line 35 into the mud pit 32. A variety of surface sensors 48, which are appropriately deployed on the surface of the borehole 26, operate alone or in conjunction with downhole sensors 70, 72 deployed within the borehole 26, to provide information about various drilling-related parameters, such as fluid flow rate, weight on bit, hook load, etc.

A surface control unit 40 may receive signals from surface and downhole sensors (e.g., sensors 48, 70, 72) and devices via a sensor or transducer 43, which can be placed on the fluid line 38. The surface control unit 40 can be operable to process such signals according to programmed instructions provided to surface control unit 40. Surface control unit 40 may present to an operator desired drilling parameters and other information via one or more output devices 42, such as a display, a computer monitor, speakers, lights, etc., which may be used by the operator to control the drilling operations. Surface control unit 40 may contain a computer, memory for storing data, a data recorder, and other known and hereinafter developed peripherals. Surface control unit 40 may also include models and may process data according to programmed instructions, and respond to user commands entered through a suitable input device 44, which may be in the nature of a keyboard, touchscreen, microphone, mouse, joystick, etc.

In some embodiments of the present disclosure, the rotatable drill bit 50 is attached at a distal end of a bottom hole assembly (BHA) 22 comprising a rotary steerable system (RSS) 58. In the illustrated embodiment, the BHA 22 is coupled between the drill bit 50 and the drill pipe section 24 of the drill string 20. The BHA 22 and or/the RSS 58 may comprise a Measurement While Drilling (MWD) System, with various sensors, e.g., sensors 70, 72, to provide information about the formation 46 and downhole drilling parameters. The MWD sensors in the BHA 22 may include, but are not limited to, a device for measuring the formation resistivity near the drill bit, a gamma ray device for measuring natural radioactivity of the formation, devices for determining the inclination and azimuth of the drill string 20, and pressure sensors for measuring drilling fluid pressure downhole. The MWD sensors may also include additional/alternative sensing devices for measuring shock, vibration, weight on bit, torque, telemetry, etc. The above-noted devices may transmit data to a downhole communicator 33, which in turn transmits the data uphole to the surface control unit 40. In some embodiments, the BHA 22 may also include a Logging While Drilling (LWD) System.

A transducer 43 can be placed in the mud supply line 38 to detect mud pulses responsive to the data transmitted by the downhole communicator 33. The transducer 43 in turn generates electrical signals, for example, in response to the mud pressure variations and transmits such signals to the surface control unit 40. Alternatively, other telemetry techniques such as electromagnetic and/or acoustic techniques or any other suitable techniques known or hereinafter developed may be utilized. By way of example, hard wired drill pipe may be used to communicate between the surface and downhole devices. In another example, combinations of the techniques described may be used. A surface transmitter/receiver 80 communicates with downhole tools using, for example, any of the transmission techniques described, such as a mud pulse telemetry technique. This can enable two-way communication between the surface control unit 40 and the downhole communicator 33 and other downhole tools.

The BHA 22 and/or RSS 58 can provide some or all of the requisite force for the bit 50 to break through the formation 46 (known as "weight on bit"), and provide the necessary directional control for drilling the borehole 26. The RSS 58 may include a steering section with steering pads 60 extendable in a lateral direction from a longitudinal axis AO of the RSS 58 to push against the geologic formation 46. The steering pads 60 may comprise hinged pads, arms, fins, rods, energized stabilizer blades or any other element extendable from the RSS 58 to contact the side 56 of the borehole 26. The steering pads 60 may be circumferentially spaced around the RSS 58, and may be individually extended to contact the side 56 of the borehole 26 to apply an opposing side force to drill bit 50 laterally to the longitudinal axis of the RSS 58 with respect to the borehole 26 while drilling. The steering pads 60 may include a set of at least three externally mounted steering pads 60 to exert force in a controlled manner to deviate the drill bit 50 in the desired direction for steering. In some embodiments, the steering pads 60 are energized by a small percentage of the drilling fluid or mud 31 pumped through the drill string 20 and drill bit 50 for cuttings removal, cooling and well control. The RSS 58 is thereby using the "free" hydraulic energy of the drilling fluid or mud 31 for directional control. For traditional electrical servomotor/solenoid-type drive systems, the power requirement is in the order of 100-300 W. The steering pads 60 may provide an adjustable force to assist in controlling the direction of the borehole 26. The RSS 58 also includes a stabilizer 62 coupled to a control section thereof.

Figure 2:
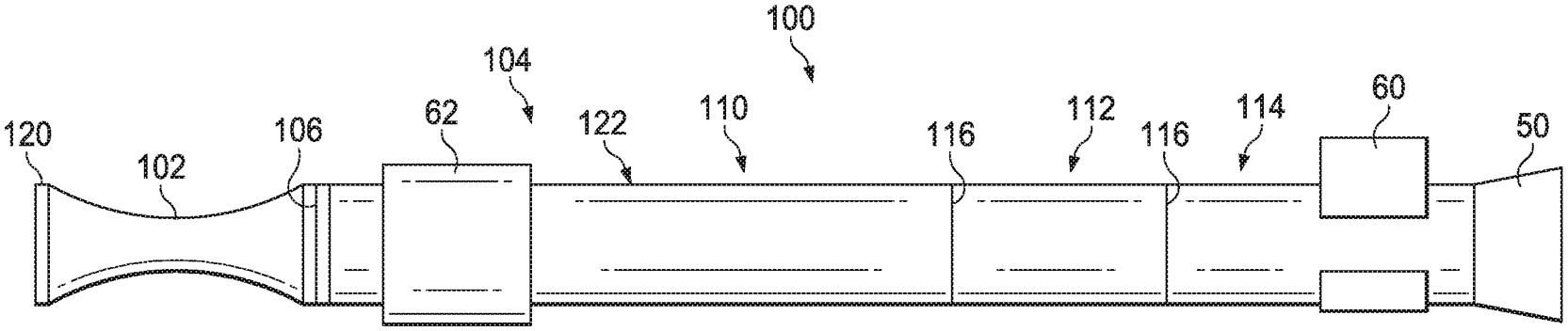
FIG. 2 is a schematic view of a bottom hole assembly including a flexible collar coupled to an up-hole end of an RSS.

FIG. 2 is a schematic view of a bottom hole assembly 100 including a flexible collar 102 coupled to an up-hole end of an RSS 104. The flexible collar 102 may include a structural connector 106 such as threads, latches, etc. at leading or downhole end thereof for selectively coupling to a trailing or uphole end of the RSS 104. The RSS 104 includes a control section 110, flow control section 112 and steering section 114, each of which may be packaged in a single housing. Alternatively, structural connectors 116 may be provided between the control section 110, the flow control section 112 and the steering section 114. The flexible collar 102 may be constructed to exhibit a lower bending stiffness than the housing or housings of the control section 110, flow control section 112 and the steering section 114. may include a drill string coupler 120 at an uphole end thereof for coupling the BHA 100 to the drill pipe section 24 (FIG. 1) of the drill string 20. The bottom hole assembly 100 may then exhibit greater flexibility than the RSS 104 alone.

The drill bit 50 is coupled to the downhole end of the steering section 114, which includes a plurality of steering pads 60 or other pushing devices for steering the drill bit 50. The steering pads 60 may be constructed as hinged pad pushers, steering pistons or similar pistons such as those found on adjustable gauge stabilizers (not shown). The flow control section 112 is coupled above the steering section 114 (or comprises an uphole portion of the steering section 114), and is operable to divert a portion of the total drilling fluid or mud 31 (FIG. 1) pumped through the BHA 100. Typically, the flow control section 112 may include a valve set 210 (FIG. 3A) that deviates about 5-8% from the main mud flow. The diverted portion passes through a filter element before being directed to the respective steering pad 60 or pushing device through flow paths defined in the steering section 114. The flow deviation is generally achieved using mechanically driven/controlled valve assemblies 210, but other arrangements are also contemplated. In order to control and drive the mechanical valve assemblies 210, servo motor, gearbox and/or bearing assemblies are traditionally employed. These gearbox and/or bearing assemblies can require volume compensation systems, if oil filling is required, and sealing solutions to prevent the ingress of drilling fluid or mud 31.

The control section 110 houses an electronics assembly 212 (FIG. 3A) including Directional and Inclination (D&I) sensor packages, Gamma Ray (GR) sensor packages, and others types of MWD or LWD sensors. The control section 110 may also include a CPU, power conditioning, and communication device (e.g., the downhole communicator 33). Power generation and/or power supply components are also generally located inside the Control Section 110. The power generation and/or supply components need to be sufficiently sized to power the electronics assembly 212, drive the mechanical valve assemblies and overcome any frictional losses created by seals, bearings, gearboxes, etc. The stabilizer 62 is coupled to an outer housing 122 of the control section 110.

The theoretical steering capability of the BHA 100 is generally defined by a curve that can be fitted through the stabilizer 62, steering pads 60 and drill bit 50. These are the components that generally contact the geologic formation 46 (FIG. 1) when forming the wellbore 26. Flexing of the control section 110, flow control section 112 and steering sections 114 can increase the steering response of the BHA 100 in operation, but flexing of these sections 110, 112, 114 is typically limited in order to prevent damage or disruption of the internal components of these sections 110, 112, 114, which could lead to a reduction in directional control accuracy (e.g., toolface control).

Figure 3A:
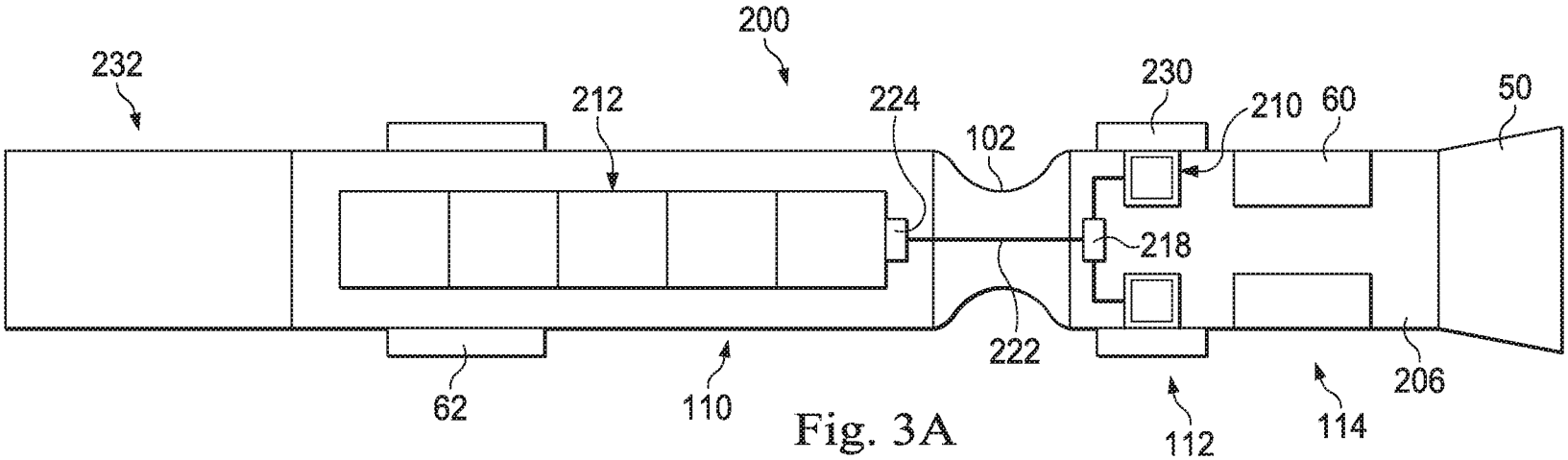
FIG. 3A is a schematic view of an RSS having a flexible collar coupled therein in accordance with the present disclosure.

FIG. 3A is a schematic view of an RSS 200 having the flexible collar 102 coupled therein, in accordance with the present disclosure. The flexible collar 102 is coupled between the steering section 114 and the control section 110. As illustrated in FIG. 3A, the flow control section 112 is housed together with the steering section 114 in a housing 206. The control section 110 includes a modular control and sensor electronics assembly 212, and the flow control section 112 includes the valve assemblies 210 and other flow control devices. The valve assemblies 210 in the flow control section 112 may require an electrical connection to the electronics assembly 212 in the control section 110 for operation. Where the valve assemblies 210 include a battery or other power source (not shown) contained in the housing 206 of the steering section 114, the valve assemblies 210 may only need instructions to be communicated across the flexible collar 102. The instructions may be received by a communication reception unit 218 of the steering section 114. Where the valve assemblies 210 do not include a power source, the valve assemblies 210 may need to receive instructions as well as power through the flexible collar 102. Instructions and data may be transmitted through an electrical conductor such as a multi-conductor communication cable 222, wire or other electrical conduit extending through the flexible collar 102. A communication transmission unit 224 may be operatively coupled to the modular electronics assembly 212 to receive instructions therefrom, and may be operatively coupled to the communication cable 222 to transmit the instructions therethrough. Since only an electrical communication cable 222 needs to pass therethrough, the flexible collar 102 with reduced bending stiffness may be added very close to the drill bit 50, i.e., directly above the steering pads 60.

A leading stabilizer 230 is provided steering section 114, and extends laterally from the housing 206. The leading stabilizer 230 may prevent a portion of the bending stresses applied to a drill string 20 (FIG. 1) extending through a curved borehole from being applied to the steering pads 60. These bending stresses have been found, in some instances, to cause the steering pads 60 to partially retract into the housing 206, thereby preventing effective steering of the drill bit 50. The leading stabilizer 230 may be disposed adjacent or above the steering pads 60, and may protrude from the same housing 206 as the steering pads 60.

A power section 232 is provided above the control section 110. The power section 232 may include turbine blades (not shown) that extract energy from drilling mud 31 (FIG. 1) pumped down the drill string 20 (FIG. 1) to generate electrical power for the electronics assembly 212, communication transmission unit 224, communication reception unit 218 and the valve assemblies 210. The valve assemblies 210 may rely on an electric motor (not shown) for selectively providing drilling mud to the steering pads 60.

Figure 3B:
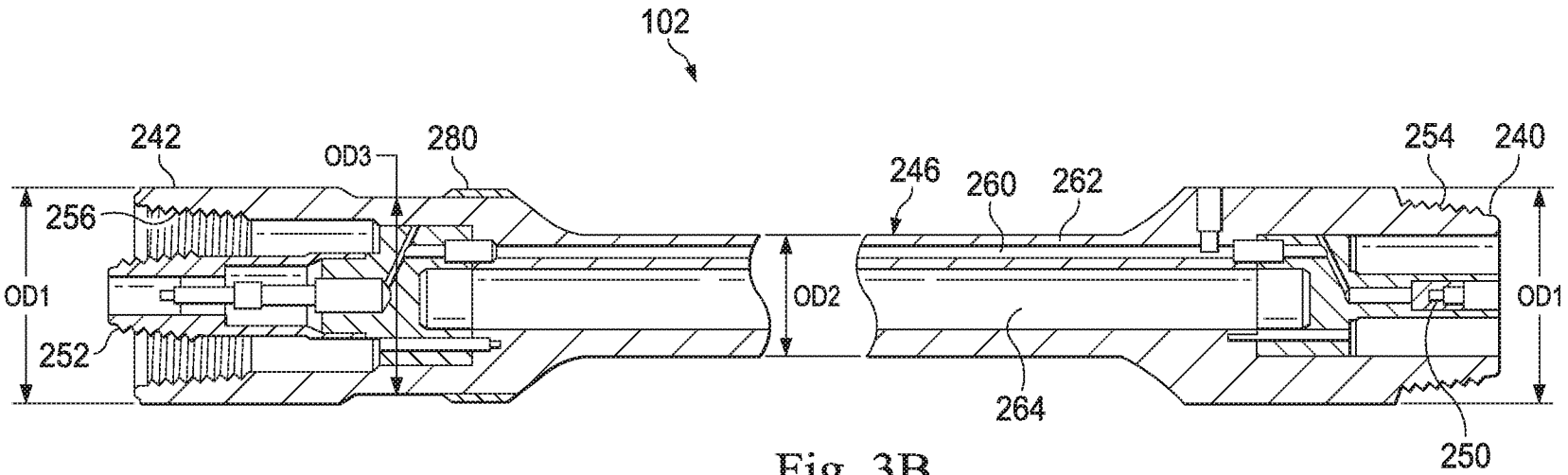
FIG. 3B is a cross sectional view of the flexible collar of FIG. 3A.

FIG. 3B is a cross-sectional view of the flexible collar 102. The flexible collar 102 generally defines a first outer diameter OD1 at leading end 240 and a trailing end 242 thereof. The first outer diameter OD1 may be similar to the outer diameters of the housings 122 (FIG. 2) and 206 (FIG. 3A) of the control section 110 and steering section 114. A reduced diameter portion 246 between the leading and trailing ends 240, 242 defines a second outer diameter OD2 that is less than the first outer diameter OD1. The reduced diameter portion 246 provides a reduced bending stiffness to the flexible collar 102. In some embodiments, the reduced diameter portion 246 may be gradually transitioned or necked down or from the leading and trailing ends 240, 242. In other embodiments, the flexible collar 102 can be implemented in forms other than a traditional necked down collar section, such as a fully articulated universal joint. The lower the bending stiffness of the flexible collar 102 or flex section, the more the tool RSS 200 (FIG. 3A) behaves like a point-the-bit rotary steerable system with the potential of achieving very high dogleg severities. The flexible collar 102 could be made replaceable to configure the RSS 200 based on required steering response. Detailed modeling may be required to determine if a particular flexible collar 102 or flex section is necessary to achieve the required dogleg severity for a particular project. In case flexing is not required, the flex collar 102 may be removed (see FIG. 7).

In other embodiments, the reduced bending stiffness of the flexible collar 102 may be provided by other geometries. For example, a flexible collar may be constructed with a constant outer diameter OD1, but with a reduced wall thickness with respect to the control section 110, flow control section 112 or the steering section 114 (FIG. 3A). Alternatively or additionally, notches or circumferential grooves may be defined in a wall of the flexible collar to provide a reduced bending stiffness. Also, a selection of materials may provide for the reduced bending stiffness. For example, where the control section 110, flow control section 112 or the housing 206 of the steering section 114 is constructed of steel, a flexible collar may be s the flexible collar 102 may be constructed of titanium or another material more flexible than steel.

A wear band 280 may be provided or applied on the trailing end 242 of the flexible collar 102. As illustrated in FIG. 3B, the wear band 280 may be disposed on a portion of the trailing end 242 that exhibits a reduced third diameter OD3 that is less than the first outer diameter OD1 and greater than the second outer diameter OD2. In other embodiments, (not shown) the wear band 280 may be applied on a portion of the leading 240 or trailing end 242 that defines the first outer diameter OD1 or a larger diameter than OD1. The wear band 280 may protect the flexible collar 102 in case of contact with the side 56 of borehole 26 (FIG. 1). Wear band 280 may comprise a hardfacing material, such as tungsten carbide matrix. The wear band 280 may comprise a metal sleeve that is press fit or shrink fit to the leading or trailing ends 240, 242, e.g., about OD1 or OD3.

Data and power transmission through the flexible collar 102 can be achieved in a variety of ways, e.g., a wired extender running through the Flex Section, electrical conductors attached to or integrated with the flexible collar 102, or even wireless power/data transmission over short distance such as electromagnetic, RF, mud pulse, infrared, and/or optical transmissions. As illustrated in FIG. 3B, the flexible collar 102 includes electrical connectors 250, 252 at the leading and trailing ends 240, 242 to facilitate coupling the flexible collar 102 to other sections 110, 112, 114, 232 of the RSS 200. The connectors 250, 252 may comprise rotary connectors, e.g., connectors that may engage corresponding connectors in other RSS sections 110, 112, 114, 232 of by relative rotational movement therebetween. In some embodiments, structural connectors 254, 256 such as threads may be provided for coupling the flexible collar 102 to other sections 110, 112, 114, 232, such that the relative rotational motion establishes both structural and electrical connections between the flexible collar 102 and the other sections 110, 112, 114, 232. In some embodiments, the connectors 250, 252 may comprise 8-pin rotational connectors to accommodate the data and power transmission through the flexible collar 102. Depending on the power requirements of the flow control section, a small battery or compact power generation module, e.g., vibration based could be included. In that case only data transmission would be required facilitating a wireless solution.

The connectors 250, 252 may be operably coupled to one another with electrical cable 222 (FIG. 3A). In some embodiments, a gun-drilled longitudinal bore 260 may be provided through a wall 262 of the flexible collar 102. The longitudinal bore 260 may be radially offset from a primary flow passage 264 extending through the flexible collar 102. Primary flow passage 264 may also be radially offset from first diameters OD1 and/or second diameter OD2 and/or third diameter OD3.

Figure 4:
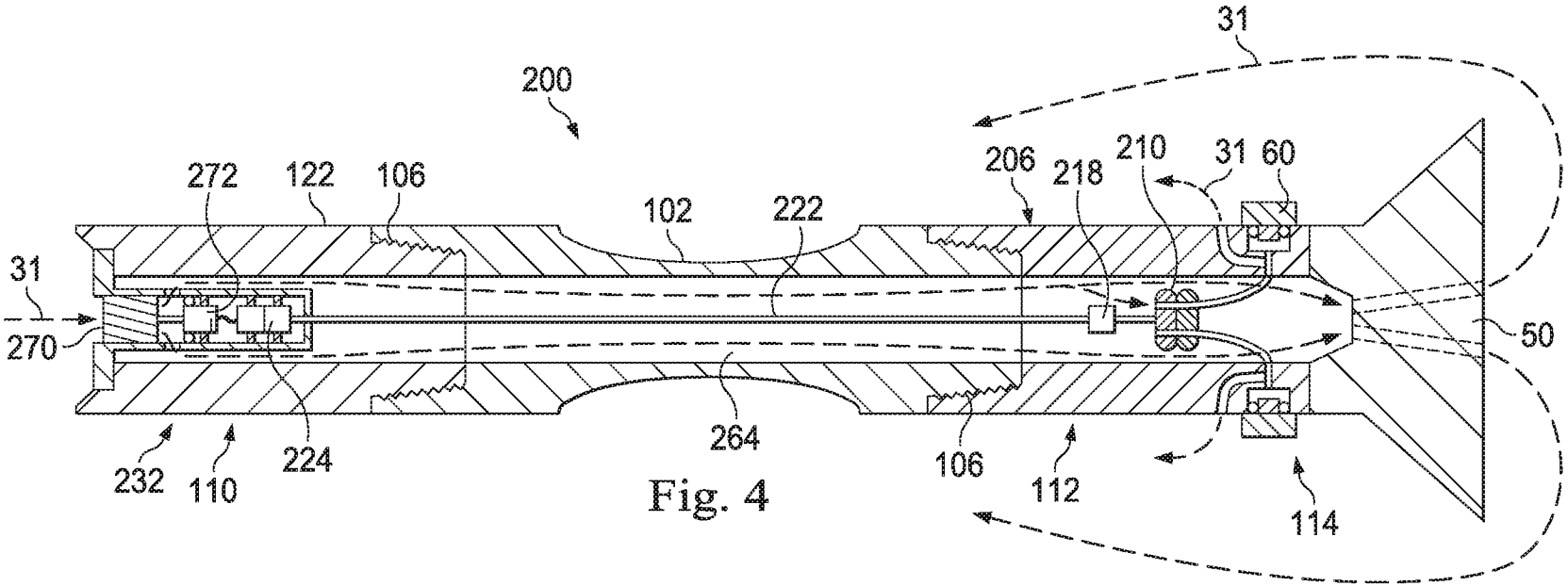
FIG. 4 is a cross-sectional side view of an RSS having a flexible collar coupled between a steering section and a control section thereof and illustrating a flow path therethrough.

FIG. 4 is a partial, cross-sectional side view of the RSS 200 illustrating a flow path therethrough. The flow path extends through the flexible collar 102, which is coupled between the flow control section 112 and the control section 110. The RSS 200 includes structural connectors 106 for receiving a flexible collar 102 between the control section 110 and the flow control section 112. As illustrated in FIG. 4, the power section 232 and the control section 110 are housed together in an outer housing 122 and the flow control section 112 steering section 114 are housed together in a housing 206. In some embodiments, structural connectors 106 may be provided between the power section 232 and the control section 110 as well as between the flow control section 112 and the steering section 114. The stabilizers 62 and 230 (FIG. 3A) associated with the housings 122, 206 are not explicitly illustrated in FIG. 4.

Fluid or mud 31 enters the power section 232 from the drill string 20 (FIG. 1). The mud 31 passes through a turbine 270, which extracts energy from the mud 31 to operate an electrical generator 272. The mud 31 passes around the electrical generator 272 and the control components such as the communication transmission unit 224. The mud 31 enters the primary flow passage 264 of the flexible collar 102 and passes into the flow control section 112. A valve assembly 210 diverts a portion of the mud 31 to selectively drive or extend the steering pads 60, and a remainder of the mud 31 continues to the drill bit 50. The diverted portion of the mud 31 is expelled through the housing 206 and the remainder of the mud is expelled through the drill bit 50.

In operation, the generator 272 provides electrical power to the electronics in the control section 110 including various sensors and circuitry that may provide instructions to the valve assembly 210. The instructions and/or electrical power may be transmitted from the communication transmission unit 224 to communication reception unit 218 through the communication cable 222. The valve 210 may then be operated according to the instructions received at the communication reception unit 218.

As indicated above, the control section 110 features a modular electronics assembly 212 (FIG. 3A) including sensor packages for D&I (direction and inclination), GR (gamma ray), and others as well as CPU, power conditioning, and communication. The power generation/supply module section 232 is also generally located inside the control section 110. In order to allow easy diagnostics and maintenance, a high degree of modularity is very desirable combined with onboard diagnostics and memory on each module 232, 110, 112, 114 to allow fault finding, service life tracking and accumulative run history capture.

Figure 5:
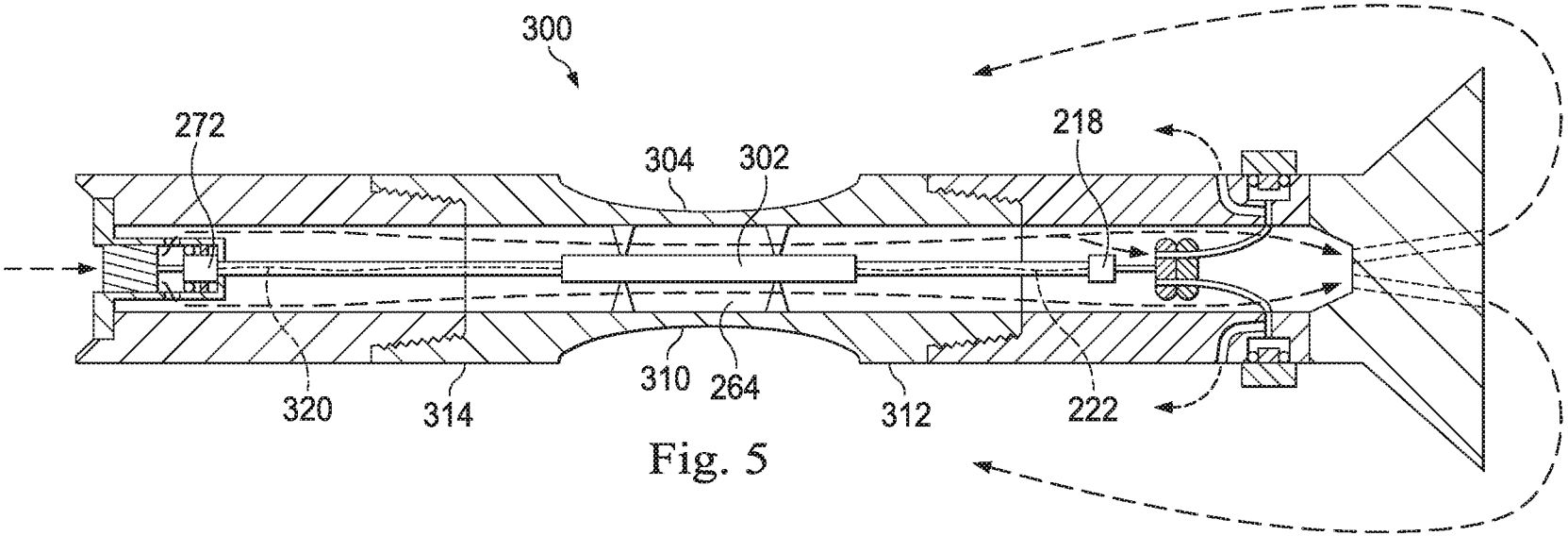
FIG. 5 is a cross-sectional side view of an RSS having a controller disposed within a flexible collar thereof.

FIG. 5 is a partial, cross-sectional side view of an RSS 300 having a controller 302 disposed within a flexible collar 304 thereof. The controller 302 may include any of the sensors and control components associated with the modular sensor and electronics assembly 212 (FIG. 3A). Where the controller 302 may withstand the flexing of the flexible collar 302, the overall length of the RSS 300 may be reduced by taking advantage of available space in the flexible collar 302. The flexible collar 302 may also be used to mount sensors to measure and record drilling parameters such as weight on bit (WOB), torque on bit (TOB), and bending moment and bending direction loads; important data that can be used as for directional control.

In some embodiments, a strain gauge (not shown) may be included in the controller 302 for measuring the bending of the flexible collar in operation. The controller 302 is illustrated as being disposed in a necked down or reduced diameter portion 310 between the leading and trailing ends 312, 314 of the flexible collar 304. In other embodiments, the controller 302 or portions of the controller 302, may be disposed in the leading and trailing ends 312, 314. The controller 302 may be coupled to the communication reception unit 218 by the communication cable 222, and may be coupled to the generator 272 by a power cable 320.

Figure 6:
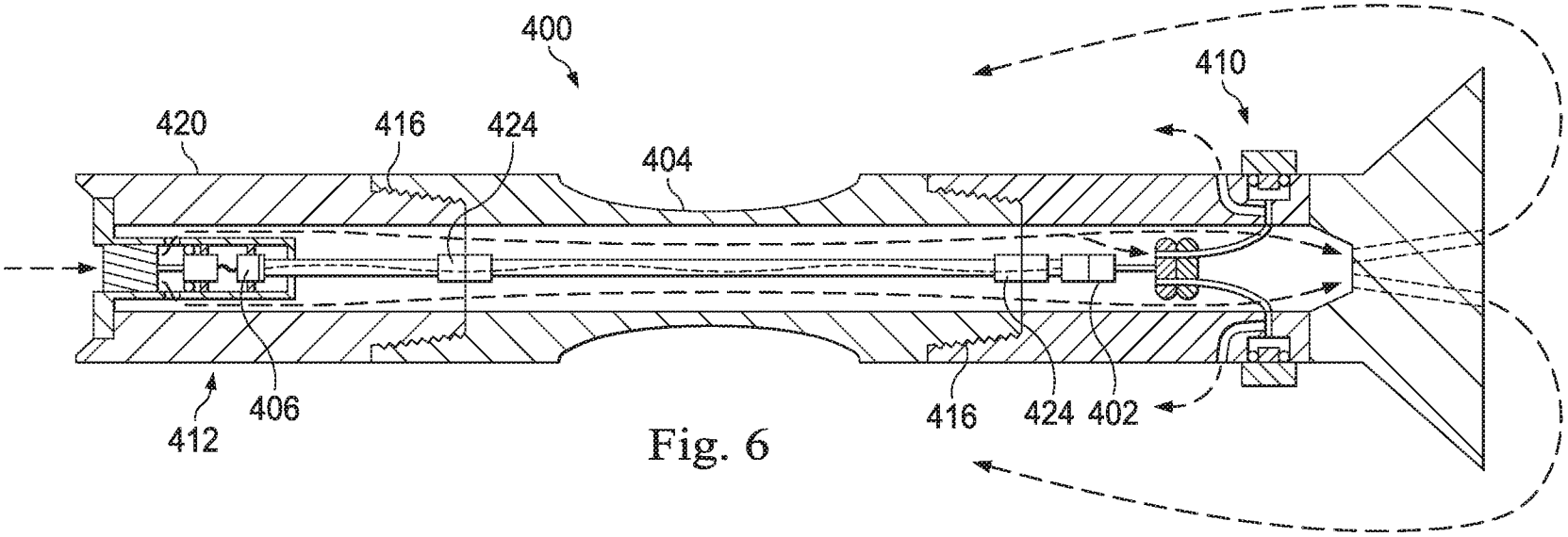
FIG. 6 is a cross-sectional side view of an RSS having a dynamic survey sensor package disposed below a flexible collar thereof and a stationary survey sensor package disposed above the flexible collar.

FIG. 6 is a cross-sectional side view of an RSS 400 having a dynamic survey sensor package 402 disposed below a flexible collar 404 thereof and a stationary survey sensor package 406 disposed above the flexible collar 404. In order to improve the steerability and response of the RSS 400, a selection of direction and inclination sensors may be placed in the dynamic survey sensor package 402 below the flexible collar 404. Placement of the dynamic survey sensor package 402 below the flexible collar 404, e.g., in a steering section 410 may provide an early indication of directional output. The flexible collar 404 within the RSS 400 will make the RSS 400 highly agile and will provide a high dogleg capability. Near bit direction; and/or inclination measurement data may be provided by the dynamic survey sensor package 402 in the steering section 410 (or in some embodiments, in the flexible collar 404) for measurement of the inclination and/or direction of the drill bit 50 and/or other characteristics of a drilling operation. The stationary survey sensor package 406 may be provided in the control section 412 for providing MWD and/or LWD capabilities, and will allow the development of more sophisticated control system and paths for automation. The near bit measurements from the dynamic survey sensor package 402 may be of a lower quality and may be combined with the higher quality D&I data from the stationary survey sensor package 406 to make steering decisions. An additional dynamic survey sensor package 403 may be provided in the control section 412 for comparison to dynamic survey sensor package 402 in the steering section 410 while drilling. Such comparison may provide an early indication of local dogleg severity, local dogleg direction as well as bending magnitude and bending direction of the flexible collar 404. The addition of dynamic survey sensor package 403 also provides redundancy to dynamic survey sensor package 402 for increased reliability during drilling operations.

Similar structural connectors 416 are provided at leading ends of the flexible collar 404 and a housing 420 of the control section 412. Also similar electrical connectors 424 may be provided at the leading ends of the flexible collar 404 and the control section 412.

Figure 7:
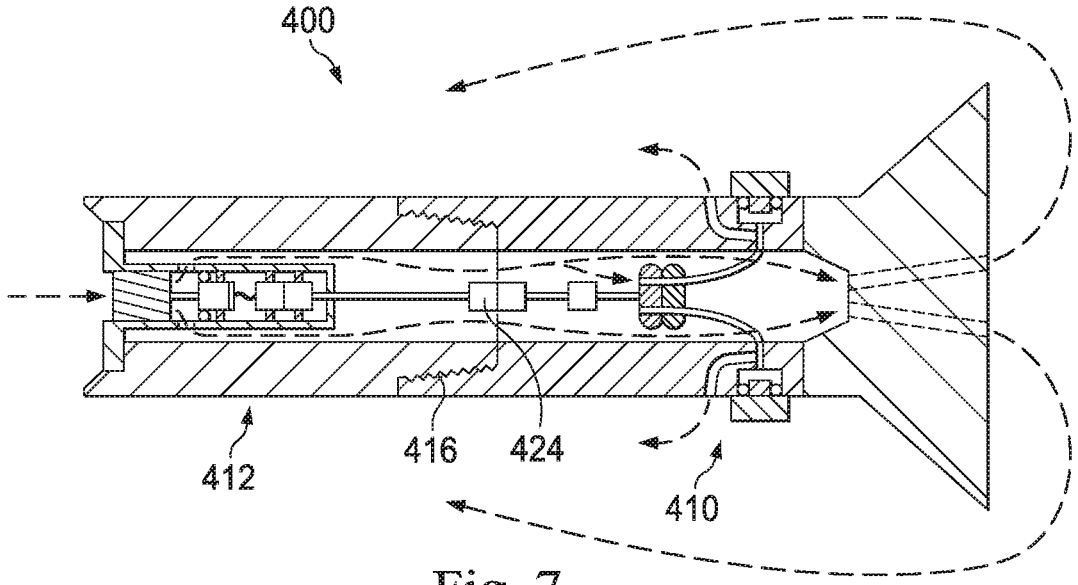
FIG. 7 is a cross-sectional side view of an RSS having a flexible collar removed therefrom.

FIG. 7 is a cross-sectional side view of the RSS 400 having the flexible collar 404 removed therefrom. The similar structural connectors 416 and electrical connectors 424 in the RSS 400 permit a direct connection between the control section 412 and steering section 410 if the flexible collar 404 is removed.

Figure 8:
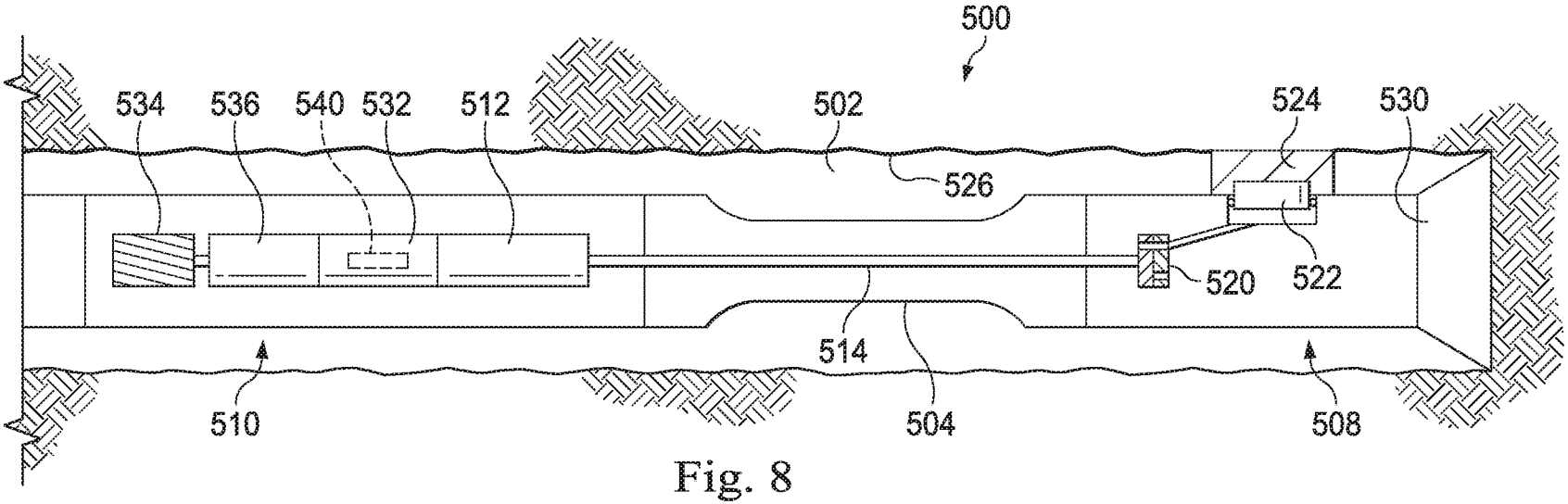
FIG. 8 is a schematic view of an RSS disposed within a wellbore, the RSS including a flexible collar disposed between a steering section and control section thereof, illustrating a valve motor disposed in the control section and a valve motor shaft extending through the flexible collar.

FIG. 8 is a schematic view of an RSS 500 disposed within a wellbore 502. The RSS 500 includes a flexible collar 504 disposed between a steering section 508 and a control section 510 thereof. A valve motor 512 is disposed in the control section 510 and a valve motor shaft 514 extends through the flexible collar 504 between the valve motor 512 and a valve 520. The valve 520 is operably coupled to a piston 522, which is in turn operably coupled to a steering pad 524 for engaging a wall 526 of the borehole 502 to steer a drill bit 530. A steering controller 532 may be operably coupled to a turbine 534 and generator 536 to receive electrical power therefrom. The steering controller 532 may control the valve motor 512, which may in turn, communicate instructions to the valve 520 in the steering section 508 through mechanical motion of the motor shaft 514. The steering controller 532 may include a stationary survey sensor 540 package therein.

Figure 9:
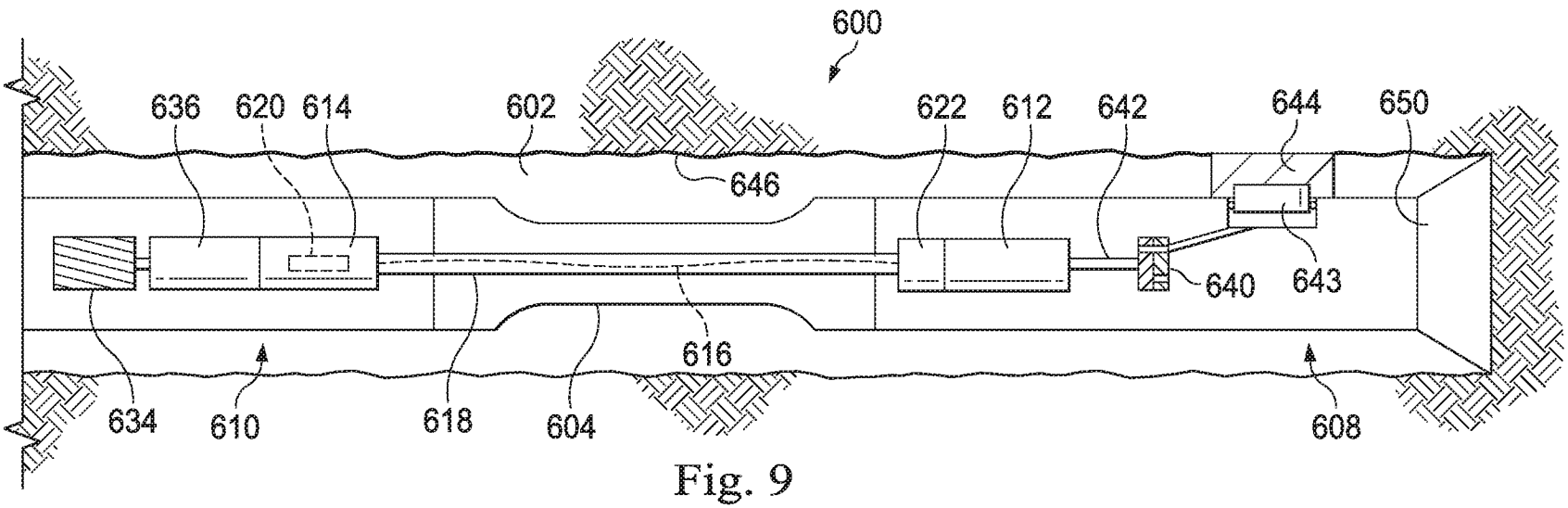
FIG. 9 is a schematic view of an RSS disposed within a wellbore, the RSS including a flexible collar disposed between a steering section and control section thereof, illustrating a valve motor disposed in the steering section and a power/control line extending through the flexible collar between a steering controller and the valve motor.

FIG. 9 is a schematic view of an RSS 600 disposed within a wellbore 602. The RSS 600 includes a flexible collar 604 disposed between a steering section 608 and control section 610 thereof. A valve motor 612 is disposed in the steering section 608 and is coupled to a steering controller 614 via a power/control line 616 extending through the flexible collar 604. The power/control line 616 may extend through a conduit 618 that isolates the power/control line 616 from drilling fluids 31 (FIG. 1). An orientation/survey sensor set or stationary survey sensor package 620 may be provided in the steering controller 614 and a secondary orientation/survey sensor set or dynamic survey sensor package 622 may be disposed on an opposite side of the flexible collar 604 in the steering section 608. The secondary orientation/survey sensor set or dynamic survey sensor package 622 is optional and may be of higher dynamic range but lower accuracy than the upper orientation/survey sensor arrangement or stationary survey sensor package 620 in the control section 610. Typically, the secondary orientation/survey sensor arrangement could be used while rotating the drill string 20 (FIG. 1) during drilling to make measurements below the flexible collar 604. The data from the stationary and dynamic survey sensor packages 620, 622, including inclination and azimuth, may be compared to one another to determine amount of difference between the two, and to determine an amount of flex and thus curvature in the bore hole 602.

A turbine 634 and generator 636 may be provided for supplying electrical power to the steering controller 614, which may distribute power among the stationary and dynamic survey sensor packages 620, 622, and the valve motor 612. The valve motor 612 is operably coupled to a valve 640 by a valve motor shaft 642. The valve 640 may be coupled to a piston 643, which is in turn operably coupled to a steering pad 644 for engaging a wall 646 of the borehole 602 to steer a drill bit 650.

The aspects of the disclosure described below are provided to describe a selection of concepts in a simplified form that are described in greater detail above. This section is not intended to identify key features or essential features of the claimed subject matter, nor is it intended to be used as an aid in determining the scope of the claimed subject matter.

In one aspect, the disclosure is directed to a rotary steerable system. The rotary steerable system includes a steering section connectable to a drill bit. The steering section defines a longitudinal axis and includes at least one steering pad selectively extendable in a lateral direction from the longitudinal axis. The rotary steerable system also includes a control section that includes a steering controller. The steering controller is operable for generating instructions to selectively extend the at least one steering pad. The rotary steerable system also includes a flexible collar coupled between steering section and the control section. The flexible collar has a reduced bending stiffness with respect to the steering section and the control section.

In one or more example embodiments, the flexible collar includes a reduced diameter central portion between leading and trailing ends of the flexible collar. The reduced diameter central portion defines an outer diameter that is less than an outer diameter of the leading and trailing ends. The flexible collar may include a primary flow passage extending therethrough and a longitudinal bore radially offset from the primary flow passage. The longitudinal bore may extend through a wall of the reduced diameter portion. The flexible collar may include an electrical conductor extending through the longitudinal bore, the electrical conductor operably coupled between a communication transmission unit in the control section and the communication reception unit in the steering section.

In some embodiments, the control section and the flexible collar each include similar structural connectors at respective leading ends thereof for selectively coupling to the steering section. In some embodiments, the control section and the flexible collar each include similar electrical connectors at the respective leading ends thereof for selectively coupling to the communication reception unit.

In one or more example embodiments, the control section includes a stabilizer thereon extending radially from a housing of the control section. In some embodiments, the steering section also includes a leading stabilizer thereon extending radially from a housing of the steering section.

In some embodiments, the steering controller communicates wirelessly with a communication reception unit across the flexible collar through electromagnetic, RF, mud pulse, infrared, optical and/or other types of signals. In some embodiments the flexible collar includes an electronics package therein, and the electronics package may be operable for controlling the at least one steering pad in the steering section.

In one or more example embodiments, the control section includes a stationary survey sensor package therein for providing MWD and/or LWD capabilities, and the steering section includes a dynamic survey sensor package therein for measurement of the inclination of the drill bit and/or other characteristics of a drilling operation in use. The dynamic survey sensor package may be less accurate than the stationary survey sensor package.

In some embodiments, the steering section includes a plurality of steering pads circumferentially spaced therearound, and a valve set operable for diverting a portion of mudflow to the steering pads. In some example embodiments, the control section includes a valve motor therein operably coupled to the steering controller, and wherein the flexible collar includes a flexible mechanical shaft extending therethrough and operably coupled between the valve motor in the control section and the valve set in the steering section.

In another aspect, the disclosure is directed to a rotary drilling system. The rotary drilling system includes a drill string, a drill bit, and a control housing coupled to a leading end of the drill string. The rotary drilling system also includes a steering controller disposed within the control housing, and the steering controller operable to generate instructions for steering the drill bit. The rotary drilling system also includes a steering housing defining a longitudinal axis and coupled to an upper end of the drill bit and at least one steering pad selectively extendable from the steering housing in response to instructions from the steering controller. The rotary drilling system also includes a flexible collar coupled between control housing and the steering housing. The flexible collar has a reduced bending stiffness with respect to the control housing and steering housing.

In one or more example embodiments, the flexible collar includes leading and trailing ends defining a first outer diameter similar to an outer diameter of the steering and control housings, and the flexible collar includes a necked-down reduced diameter portion between the leading and trailing ends. The reduced diameter portion may define a second outer diameter less than the first outer diameter. In some embodiments, the flexible collar includes a primary flow passage in fluid communication with the drill string, and a longitudinal bore radially offset from the primary flow passage and having an electrically conductive cable extending therethrough for communicating the instructions from the steering controller through the flexible collar. In some embodiments, the rotary drilling system further includes a stationary survey sensor package disposed within the control housing, a dynamic survey sensor disposed within the steering housing, and a surface control unit operably coupled to the stationary and dynamic survey sensor packages for receiving measurements of the direction and inclination of the drill bit.

In another aspect, the disclosure is directed to a method for drilling a wellbore. The method includes (a) conveying a rotary steerable system into a wellbore, (b) generating instructions for steering a drill bit coupled to a lower end of the rotary steerable system with a steering controller disposed within a control housing of the rotary steerable system, (c) transmitting the instructions across a flexible collar of the rotary steerable system, the flexible collar having a reduced bending stiffness with respect to the control housing, and (d) extending at least one steering pad from a steering housing of the rotary steerable system coupled below the flexible collar in response to receiving the instructions from the steering controller below the flexible collar.

In some example embodiments, the method further includes removing the flexible collar from the rotary steerable system and coupling the control housing directly to the steering housing. In some embodiments, the method further includes comprising measuring a direction and inclination of the drill bit with a stationary survey sensor package disposed above the flexible collar, and measuring the direction and inclination of the drill bit with a dynamic survey sensor package disposed above the flexible collar. In some embodiments, the method further comprises measuring a direction and inclination of the drill bit with an additional dynamic survey sensor package disposed above the flexible collar and comparing measurements made above the flexible collar with measurements made below the flexible collar.

The Abstract of the disclosure is solely for providing the United States Patent and Trademark Office and the public at large with a way by which to determine quickly from a cursory reading the nature and gist of technical disclosure, and it represents solely one or more examples.

While various examples have been illustrated in detail, the disclosure is not limited to the examples shown. Modifications and adaptations of the above examples may occur to those skilled in the art. Such modifications and adaptations are in the scope of the disclosure.

What is claimed is:

1. A rotary steerable system, comprising:

a steering section connectable to a drill bit, the steering section defining a longitudinal axis and including at least one steering pad selectively extendable in a lateral direction from the longitudinal axis;

a control section including a steeling controller for generating instructions to selectively extend the at least one steering pad;

a flexible collar between steering section and the control section, the flexible collar having a lower bending stiffness than the steering section and the control section;

a mud flow path extending through the steering section, the control section and the flexible collar of the rotary steerable system;

at least one diversion passage extending between the mud flow path and the at least one steering pad; and a valve set in fluid communication with the mud flow path, the valve set operable for diverting a portion of mud flowing through the mud flow path to the at least one diversion passage for selectively extending the at least one steering pad.

2. The rotary steerable system according to claim 1, wherein the flexible collar includes a reduced-diameter central portion between leading and trailing ends of the flexible collar.

3. The rotary steerable system according to claim 2, wherein the flexible collar includes a primary flow passage extending therethrough, the primary flow passage forming a portion of the mud flow path, and wherein the flexible collar further includes a longitudinal bore radially offset from the primary flow passage and extending through a wall of the reduced diameter portion.

4. The rotary steerable system according to claim 3, wherein the flexible collar includes an electrical conductor extending through the longitudinal bore, the electrical conductor operably coupled between a communication transmission unit in the control section and a communication reception unit in the steering section.

5. The rotary steerable system according to claim 1, wherein the control section and the flexible collar each include similar structural connectors at respective leading ends thereof for selectively coupling to the steering section, and wherein the control section and the flexible collar each include similar electrical connectors at the respective leading ends thereof for selectively coupling to a communication reception unit in the steering section.

6. The rotary steerable system according to claim 1, wherein the control section includes a stabilizer thereon extending radially from a housing of the control section.

7. The rotary steerable system according to claim 6, wherein the steering section includes a leading stabilizer thereon extending radially from a housing of the steering section.

8. The rotary steerable system according to claim 1, wherein the steering controller communicates wirelessly with a communication reception unit across the flexible collar through electromagnetic, RF, mud pulse, infared, optical and/or other types of signals.

9. The rotary steerable system according to claim 1, wherein the flexible collar includes an electronics package therein, the electronics package operable for controlling the at least one steering pad in the steering section.

10. The rotary steerable system according to claim 1, wherein the control section includes a stationary survey sensor package therein for providing MWD and/or LWD capabilities, and wherein the steering section includes a dynamic survey sensor package therein for measurement of the inclination of the drill bit and/or other characteristics of a drilling operation in use.

11. The rotary steerable system according to claim 10, further comprising an additional dynamic survey sensor package disposed in the control section above the flexible collar, and wherein the dynamic survey sensor package and the additional dynamic survey sensor package are less accurate than the stationary survey sensor package.

12. The rotary steerable system according to claim 1, wherein the steering section includes a plurality of steering pads circumferentially spaced therearound, wherein the at least one diversion passage includes a respective diversion passage extending between the mud flow path and each steering pad of the plurality steering pads, wherein the valve set is operable for diverting a portion of mudflow to each steering pad of the plurality of steering pads, and wherein each diversion passage extends laterally through a housing of the steering section for expelling the diverted portion of the mudflow.

13. The rotary steerable system according to claim 12, wherein the control section includes a valve motor therein operably coupled to the steering controller, and wherein the flexible collar includes a flexible mechanical shaft extending therethrough and operably coupled between the valve motor in the control section and the valve set in the steering section.

14. A rotary drilling system, comprising a drill string;

a drill bit;

a control housing coupled to a leading end of the drill string;

a steering controller disposed within the control housing, the steering controller operable to generate instructions for steering the drill bit;

a steering housing defining a longitudinal axis and coupled to an upper end of the drill bit;

at least one steering pad selectively extendable from the steering housing in response to instructions from the steering controller;

a flexible collar coupled between control housing and the steering housing, the flexible collar having a reduced bending stiffness with respect to the control housing and steering housing;

a mud flow path fluidly coupled to the drill string, the mud flow path extending through the steering housing, the control housing and the flexible collar;

at least one diversion passage extending between the mud flow path and the at least one steering pad; and a valve set in fluid communication with the mud flow path, the valve set operable for diverting a portion of mud flowing through the mud flow path to the at least one diversion passage for selectively extending the at least one steering pad.

15. The rotary drilling system according to claim 14, wherein the flexible collar includes leading and trailing ends defining a first outer diameter similar to an outer diameter of the steering and control housings, and wherein the flexible collar includes a reduced diameter portion between the leading and trailing ends, the reduced diameter portion defining a second outer diameter less than the first outer diameter.

16. The rotary drilling system according to claim 14, wherein the flexible collar includes a primary flow passage in fluid communication with the drill string, the primary flow passage forming a portion of the mud flow path, and wherein the flexible collar further includes a longitudinal bore radially offset from the primary flow passage and having an electrically conductive cable extending therethrough for communicating the instructions from the steering controller through the flexible collar.

17. The rotary drilling system according to claim 14, further comprising a stationary survey sensor package disposed within the control housing, a dynamic survey sensor disposed within the steering housing, and a surface control unit operably coupled to the stationary and dynamic survey sensor packages for receiving measurements of the direction and inclination of the drill bit.

18. A method for drilling a wellbore, the method comprising:

conveying a rotary steerable system into a wellbore;

establishing a mudflow in a mud flow path defined through the rotary steerable system in the wellbore;

generating instructions for steering a drill bit coupled to a lower end of the rotary steerable system with a steering controller disposed within a control housing of the rotary steerable system;

transmitting the instructions across a flexible collar of the rotary steerable system, the flexible collar having a reduced bending stiffness with respect to the control housing;

receiving the instructions in a steering housing coupled to a lower end of the flexible collar;

diverting a portion of the mud flow from the mud flow path to at least one diversion passage extending between the mud flow path and at least one steering pad in response to receiving the instructions;

extending the at least one steering pad from a steering housing of the rotary steerable system coupled below the flexible collar in response to receiving the instructions from the steering controller below the flexible collar; and expelling the diverted portion of the mudflow from the at east one diversion passage laterally through the steering housing.

19. The method according to claim 18, further comprising measuring a direction and inclination of the drill bit with a stationary survey sensor package disposed above the flexible collar, and measuring the direction and inclination of the drill hit with a dynamic survey sensor package disposed below the flexible collar.

20. The method according to claim 19, further comprising measuring the direction and inclination of the drill bit with an additional dynamic survey sensor package disposed above the flexible collar and comparing measurements made above the flexible collar with measurements made below the flexible collar.

* * * * *